US005213269A

United States Patent [19]

Srinath et al.

[11] Patent Number: 5,213,269

[45] Date of Patent: May 25, 1993

[54] LOW COST, LOW PRESSURE, FEEDBACK PASSAGE-FREE FLUIDIC OSCILLATOR WITH INTERCONNECT

[75] Inventors: Dharapuram Srinath, Hanover; Ronald D. Stouffer, Silver Spring, both of Md.

[73] Assignee: Bowles Fluidics Corporation, Columbia, Md.

[21] Appl. No.: 816,978

[22] Filed: Jan. 7, 1992

Related U.S. Application Data

[63] Continuation-in-part of Ser. No. 771,979, Oct. 8, 1991, Pat. No. 5,181,660, which is a continuation-in-part of Ser. No. 759,557, Sep. 13, 1991.

[51] Int. Cl.[5] ..... B05B 1/08

[52] U.S. Cl. ..... 239/589.1; 239/DIG. 3; 137/826

[58] Field of Search ..... 239/589.1, 590, DIG. 3; 137/810, 811, 813, 825, 835, 826

[56] References Cited

U.S. PATENT DOCUMENTS

| | | | |
|---|---|---|---|
| 4,151,955 | 5/1979 | Stouffer | 239/589.1 |
| 4,260,106 | 4/1981 | Bauer | 239/589.1 |
| 4,398,664 | 8/1983 | Stouffer | 137/833 |
| 4,508,267 | 4/1985 | Stouffer | 239/589.1 |
| 4,562,867 | 1/1986 | Stouffer | 239/589.1 |
| 4,662,568 | 5/1987 | Bauer | 239/589.1 |
| 4,721,251 | 1/1988 | Kondo et al. | 239/589.1 |
| 4,838,091 | 6/1989 | Markland et al. | 137/835 |

*Primary Examiner*—Andres Kashnikow
*Assistant Examiner*—Christopher G. Trainor
*Attorney, Agent, or Firm*—Jim Zegeer

[57] ABSTRACT

A fluidic oscillator which is free of feedback passages has an oscillation chamber having a length greater than its width, a pair of mutually facing and complementary-shaped sidewalls, planar top and bottom walls, and first and second end walls. An input power nozzle is formed in said first end wall having a width W and a depth D, for issuing a stream of fluid into the oscillation chamber, and form alternately pulsating, cavitation-free vortices in said oscillation chamber on each side of the stream. An interconnect passage or channel proximate the downstream end wall enlarges the sweep angle and improves periodicity of the oscillations. The outlet wall is hingedly connected to a chamber wall and the chamber is such that it can be molded with the outlet wall hingedly connected thereto in one molding and forms one side of the interconnect passage or channel.

6 Claims, 5 Drawing Sheets

FIG. 13
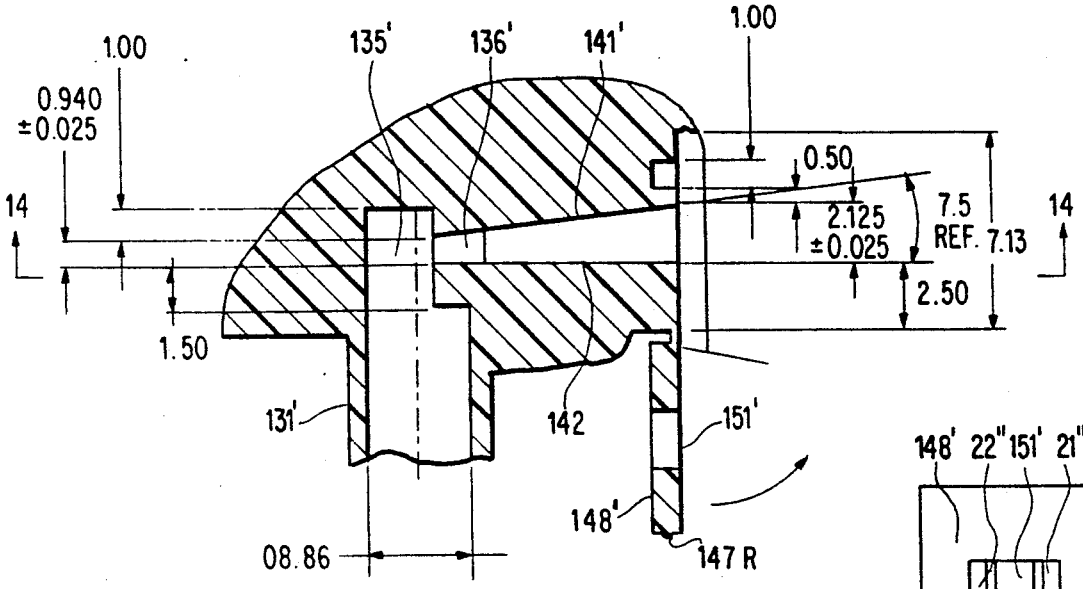
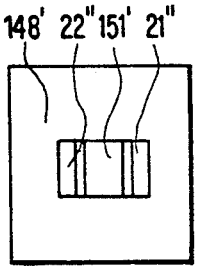
FIG. 15
FIG. 14
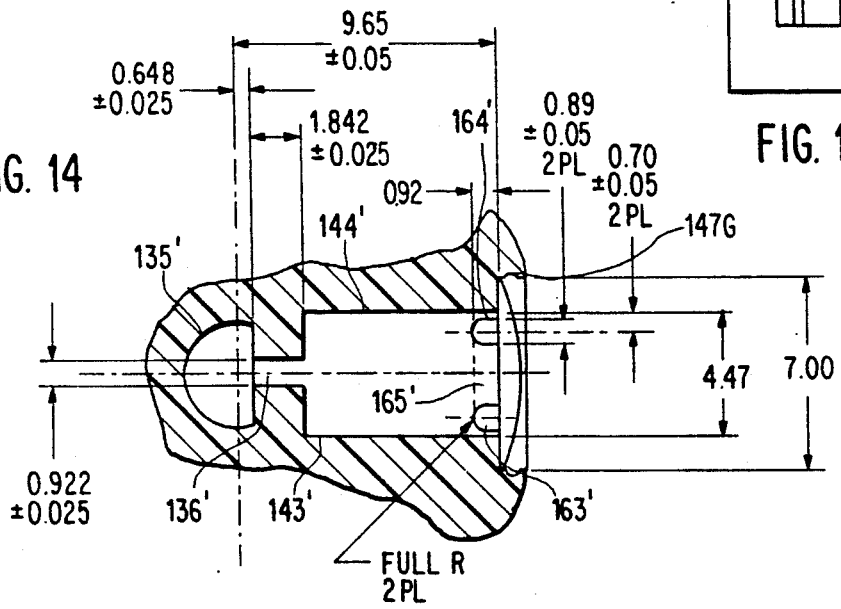

LOW COST, LOW PRESSURE, FEEDBACK PASSAGE-FREE FLUIDIC OSCILLATOR WITH INTERCONNECT

REFERENCE TO RELATED APPLICATIONS

This application is a continuation-in-part of our U.S. patent application Ser. No. 07/771,979 filed Oct. 8, 1991, entitled "LOW COST, LOW PRESSURE, FEEDBACK PASSAGE-FREE OSCILLATOR WITH STABILIZER", now U.S. Pat. No. 5,181,660 which is a continuation-in-part of our U.S. patent application Ser. No. 07/759,557 filed Sep. 13, 1991 entitled "LOW COST, LOW PRESSURE FLUIDIC OSCILLATOR WHICH IS FREE OF FEEDBACK PASSAGES".

BACKGROUND AND BRIEF DESCRIPTION OF THE INVENTION

This invention relates to a fluidic oscillator, especially a liquid oscillator, which is one-piece moldable and of the type disclosed in the above applications, and in which the sweep angle is enlarged simultaneously with improvement in the periodicity of oscillations.

There are a large number of fluidic oscillators useful for issuing a sweeping fluid stream into ambient. See, for example, Stouffer U.S. Pat. Nos. 4,652,002, 4,508,267, Bray U.S. Pat. Nos. 4,463,904, 4,645,126, Turner U.S. Pat. No. 3,432,102, Walker U.S. Pat. No. 3,507,275, Viets U.S. Pat. No. 3,998,386, Stouffer et al. U.S. Pat. No. RE 33,158, Bauer U.S. Pat. No. 4,157,167, Stouffer U.S. Pat. No. 4,151,155, and Bauer U.S. Pat. No. 4,184,636 are free of feedback channels: Stouffer '155 depends on vortices alternately shed from an island and Bauer '636 uses a reversing chamber feeding a separate output chamber. While Stouffer '155 can be molded in a single molding so that it does not require assembly, its frequency of oscillation is high. In a previous oscillating device called a "Travetron", alternating vortices were formed but these were high pressure devices and the vortices cavitated and the oscillation chamber was wider than it was long. U.S. Pat. No. 4,721,251 discloses a fluidic oscillator having walls defining first and second chambers with the second chamber being stepwise widened from the first chamber and having a "turn" wall for turning the branch flow therein to collide with a deflected main jet to push the main jet in an opposite direction. The laterally spaced sidewalls of the first chamber serve as sucking and deflecting walls. The second chamber and its laterally displaced sidewalls make the unit wider than its length.

In our above-referenced U.S. patent application Ser. No. 07/759,557, the oscillator functions with a slight aperiodicity and noise. Our U.S. patent application Ser. No. 07/771,979 provided an improved fluidic oscillating nozzle for dispersal or distribution of fluid in which oscillation is enhanced relative to the periodicity and noise reduction of the oscillation, and more particularly, to a feedback passage-free oscillator having stabilizer means and which operates at low pressure and which can be made at lower cost, preferably in a single molding and does not require expensive assembly equipment and which eliminates problems from sealing. The unit is simpler than prior art designs and has a good fan angle.

According to our U.S. patent application Ser. No. 07/771,979, a low pressure, feedback passage-free fluidic oscillating nozzle has an oscillation chamber having a length L which is greater than its width W, with top and bottom walls, a pair of mutually facing sidewalls, an upstream wall and a downstream wall. An input power nozzle is formed in the upstream wall and has a width PW and a depth D and issues fluid into the oscillation chamber. The downstream wall or side of the oscillation chamber has an outlet formed therein such that pressure within the chamber is always positive relative to ambient. A pair of short walls diverge from the outlet opening in a downstream direction. A feature of that invention is that a pair of alternating pulsating, cavitation-free controlling vortices are formed in the chamber on each side of the fluid stream flowing through the chamber and centers thereof are translated as they grow and stabilizer rib means in the top and/or bottom walls aid the controlling vortices at their downstream supply from the jet and retard them at their upstream end to impart a net increase in strength to the controlling vortices.

THE PRESENT INVENTION

The present invention includes an interconnect passage or channel which interconnects portions of the oscillation chamber on each side of the centerline of thereof proximate the liquid outlet throat. This interconnect passage or channel significantly enlarges the sweep angle of the jet issued to ambient and improves the periodicity of the oscillations in the oscillation chamber. In the preferred embodiment, the device is injection molded in one piece with a closure member hingedly connected to a main body member in which the oscillation chamber is formed along with a feed member to the power nozzle. The outlet opening is formed in the closure member. In the preferred embodiment, the interconnecting passage or channel is formed in a generally "U" shape with one side of the "U" structure open and the other side closed when the closure member and the main body member are sealingly engaged with one another. Thus, the interconnecting passage can be molded into the main body member or the closure member, or a portion of the passage formed in the closure member and a portion formed in the main body member. The edges of the closure member sealingly engage a corresponding edge of the main body member. In the preferred embodiment, the oscillation chamber has floor and ceiling walls which diverge from each other in a downstream direction from the power nozzle.

Fluidic oscillating nozzles of the present invention are particularly adapted for the dispersion of liquids into the atmosphere. However, it is to be understood that gases and mixtures of gases and liquids can be used in the broader aspects and practice of the invention.

DETAILED DESCRIPTION OF THE DRAWING

Figure 1:
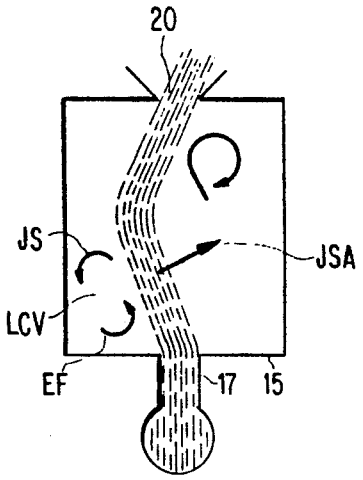
Figure 8:
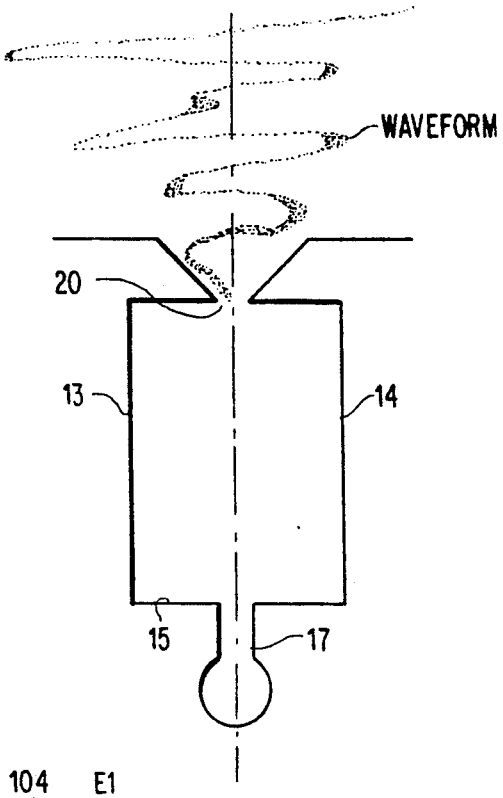
Figure 9:
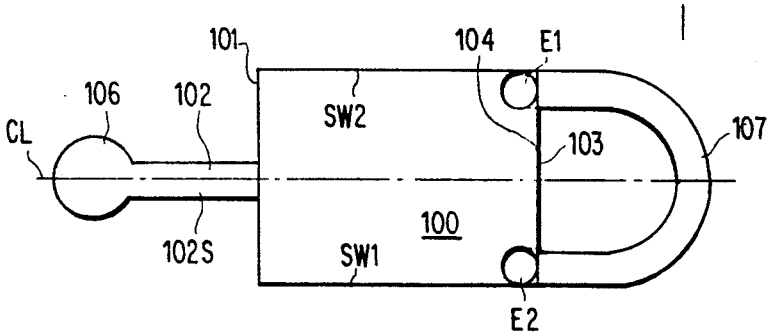
Figure 10:
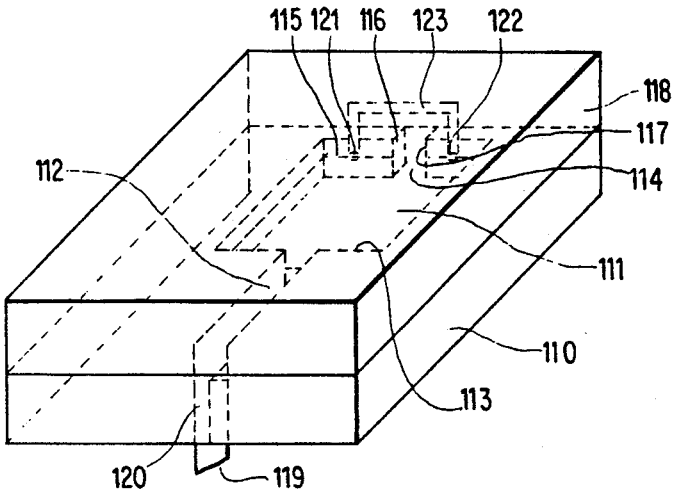
Figure 11A:
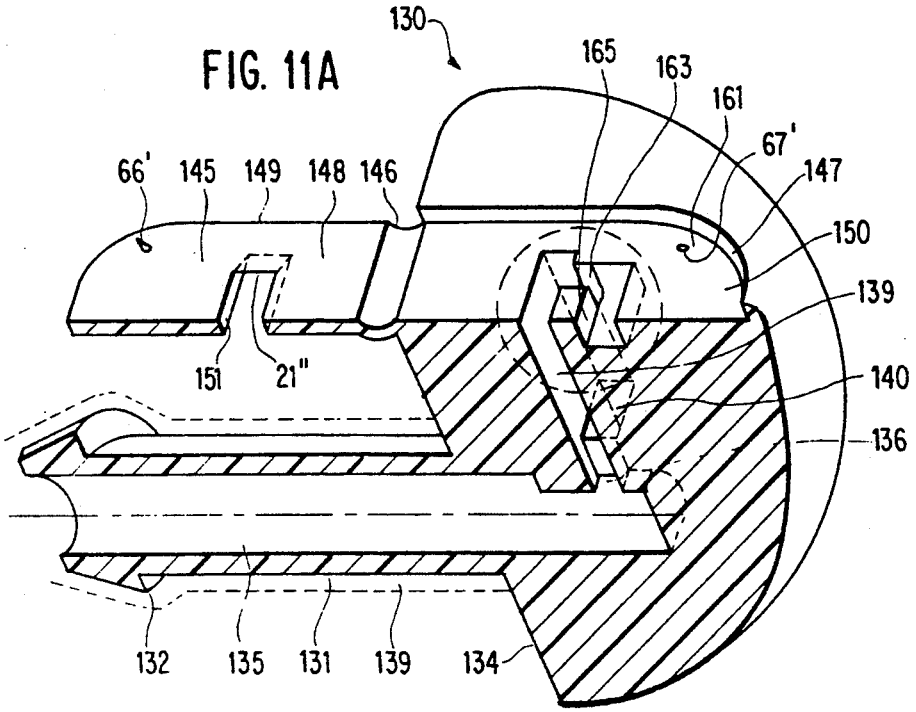
Figure 11B:
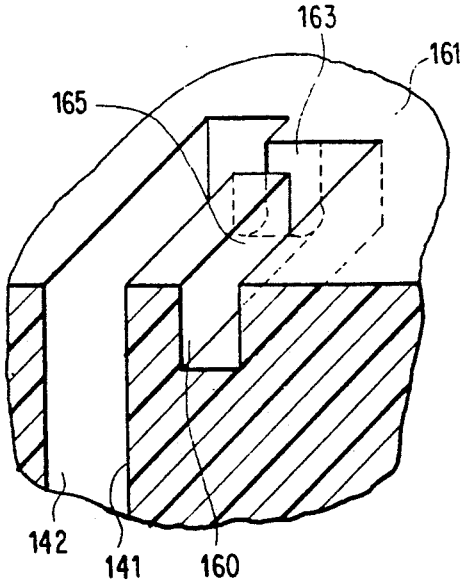
Figure 12:
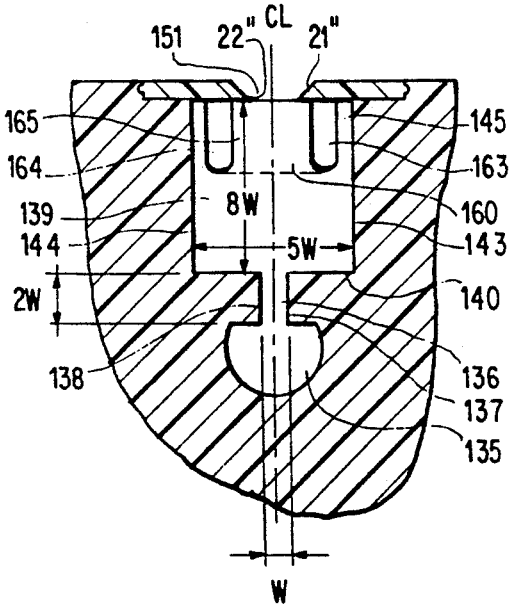
Figure 16:
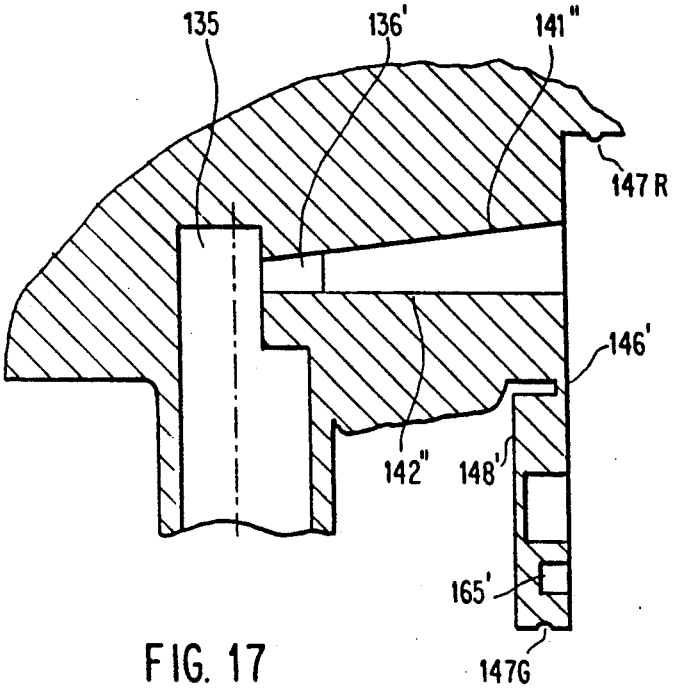
Figure 18:
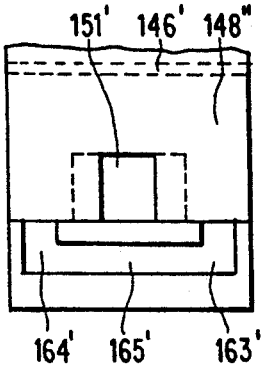
Figure 17:
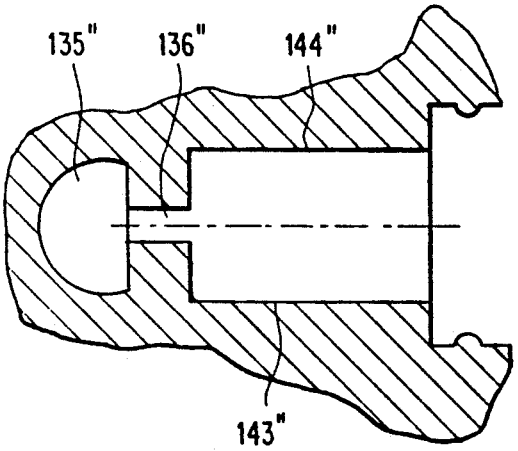
Figure 19:
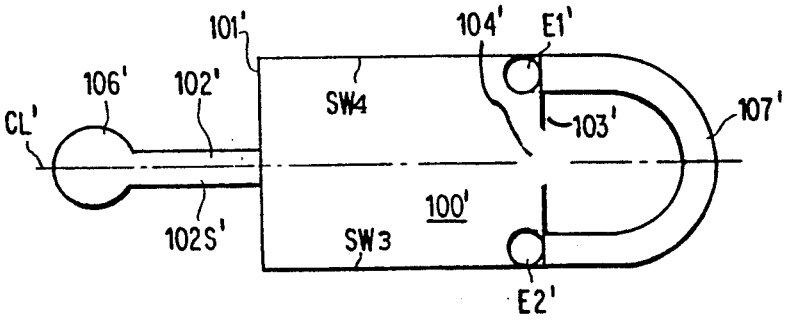

The above and other objects, advantages and features of the invention will become more apparent when considered with the following specification and accompanying drawings wherein:

FIG. 1 is a plan view of a silhouette of a fluidic oscillator showing the basic geometry of the jet oscillator, FIGS. 2–7 are diagrammatic illustrations of sequential states of the operative vortices within the oscillation chamber, FIG. 8 illustrates output waveform characteristics of a jet of liquid issued to ambient, FIG. 9 is a schematic diagram of a fluidic oscillator incorporating the present invention, FIG. 10 is an isometric view of a fluidic oscillator incorporating the present invention, FIG. 11*a* is a sectional isometric view of a fluidic oscillator incorporating the present invention, and FIG. 11*b* is an enlargement of the portion of FIG. 11*a* enclosed by the circle, FIG. 12 is a sectional view through the center of FIG. 11*a* and looking-up, FIG. 13 is a sectional view of a preferred embodiment of a fluidic oscillator incorporating the invention, FIG. 14 is a sectional view taken on lines 14—14 of FIG. 13, FIG. 15 is an end view of the closure member shown in FIG. 13, FIG. 16 is a sectional view similar to FIG. 13 but showing the sweep angle enhancement interconnect passage formed in the closure member, FIG. 17 is a sectional view of the device shown in FIG. 16, FIG. 18 is an view of the cover member showing formation of the interconnect and sweep angle enhancement passage therein, and FIG. 19 is a plan view of a silhouette of a fluidic oscillator incorporating the invention and having a diverging sidewalls.

DETAILED DESCRIPTION OF THE INVENTION

Referring to FIG. 1, the general feedback passage-free geometry of the invention allows the jet supply JS on the left controlling vortex LCV to exceed entrainment flow EF by the jet 30. When this happens, the left controlling vortex LCV becomes a separation-type vortex which expands. Its associated high pressure field reacts on the jet stream 30 to move it away from the wall (the left wall in FIG. 1). The controlling vortex CV is supplied proportionately more (compared to the entrainment) by the jet as the jet 30 moves closer to the opposite wall (the right wall in FIG. 1), the jet stream 30 being deflected in the direction indicated by jet stream deflection arrow JSA. The vortex acts like a spring, therefore producing a restoring force (jet towards center) proportional to the proximity of the jet to the wall. This spring-like action of the left controlling vortex in alternate cooperation with the right controlling vortex on the right chamber side produces the oscillation which causes the jet issuing through the outlet 20 to sweep back and forth and form droplets for dispersal upon a windshield, for example of a vehicle, or for squeegee bottles, etc. Droplet size can be tailored for specific applications.

Preferably, the outlet opening 20 is coaxial with the power nozzle 17 and has a width and depth such that internal pressure in the chamber is greater than ambient so as to preclude ingestion of ambient fluids such as air. This also assists in assuring, when liquid is used, that the pair of operative vortices formed in the chamber are cavitation-free. Moreover, the width of the outlet opening is such that in start-up operation, a portion of the edges of the jet or stream issuing through power nozzle 17 is scooped-off at both sides of the jet to initiate the "start-up" operation shown in FIGS. 2–4. Outlet 20 has a pair of short diverging walls 21, 22.

Figure 2:
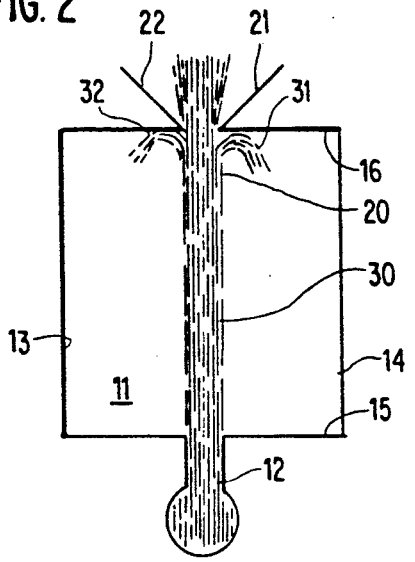
Figure 3:
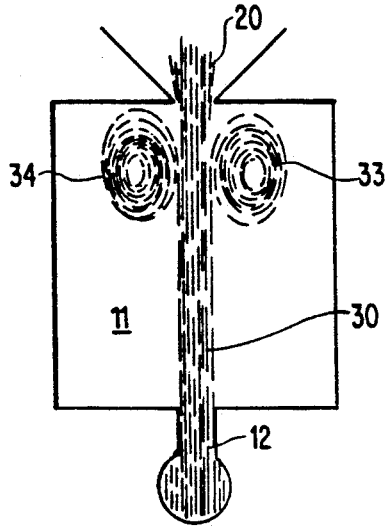
Figure 4:
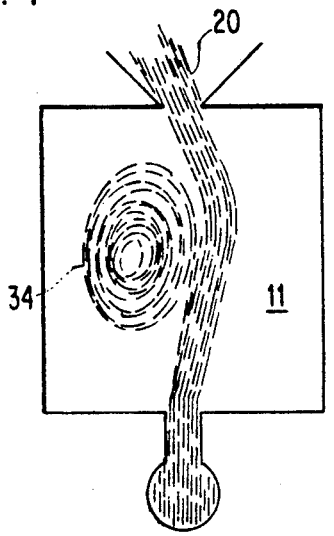

As disclosed in our U.S. patent application Ser. No. 07/771,979, oscillation can be improved relative to the periodicity and noise reduction of the oscillation by incorporating stabilization means in the form of one or more stabilization ribs in a preferred embodiment on the tapered top or bottom wall. Referring now to FIGS. 2–4, a jet or stream 30 of liquid such as a windshield wash liquid for automobile windshields, or propane fuel for a torch having an oscillating nozzle thereon, etc., is projected at relatively low pressure (down to about one psi).

The portions 31, 32 scooped-off of each side by the edges form vortices 33, 34, which grow or enlarge in the chamber halves defined by the power stream or jet 30. At this state, the main power stream exits outlet 20 in a straight or undeflected line. Because of some minor pertuberance in the chamber or power stream, one of vortices 33 or 34 will grow stronger and become dominant and, as shown in FIG. 4, vortex 34 has become dominant (because vortice 33 is not dominant, it is not shown in FIG. 4 as it has started to dissipate and move out of the chamber) and is pushing or deflecting the jet 30 to the right causing the main jet 30 to exit through outlet 20 to the left.

Figure 5:
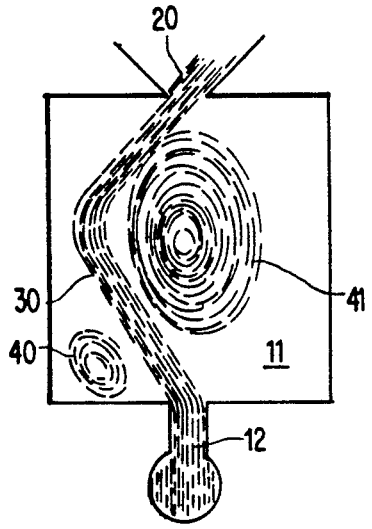
Figure 6:
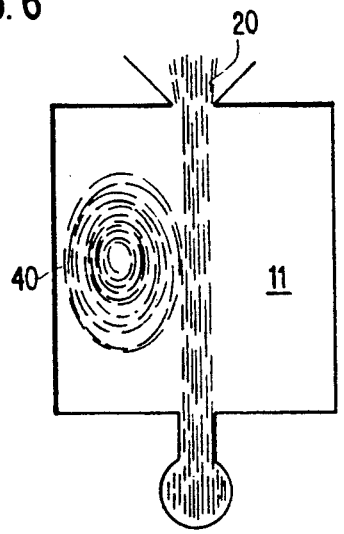
Figure 7:
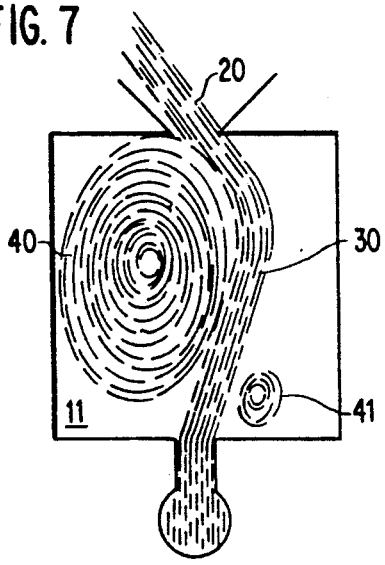

FIGS. 5–7 illustrate one full oscillation operation or sequence following the start-up shown in FIGS. 2–4. Referring to FIG. 5, the jet 30 is shown pushed or deflected to the left (with the jet issuing to the right) and a small strong circulation vortex 40 is formed in the lower left-hand corner. This vortex is formed differently than the start-up vortices 33, 34, and it grows or expands by drawing fluid from jet 30. The large weak vortex 41 is beginning to be dissolved or dissipated while in the left half of chamber 11, vortex 40 grows and the center thereof translates in a downstream direction to where the vortex begins to act to deflect or bend the jet 30 to the right. As shown in FIG. 6, the large weak circulation of vortex 41 dissolves into the main jet 30 and moves out of the unit through output opening 20. Finally, after the jet 30 is fully deflected to the right (FIG. 7), with the jet exiting to the left, vortex 40 has grown to its maximum expansion and a new vortex 41 forms in the lower right-hand corner and the process repeats itself.

The output characteristics are illustrated in FIG. 8. The waveform 50 is shown as having jagged edges, but is uniform in fluid distribution. The jagged edges of the waveform in this illustration result from random aperiodicity of jet travel.

In FIG. 10*a*, the outlet end of the chamber is illustrated as formed by a closure 63 which is hinged by integrally molded hinge 50. In this unit, the outlet wall 69 is adapted to snap into and seal socket 51 formed in the downstream end of the oscillation chamber.

A sectional view through a single molding of the embodiment is illustrated in FIG. 10*a*, with the downstream wall hingedly coupled to the main body portion. FIG. 10*b* shows a sectional view with the downstream wall snapped in place. The main body 60 shows half of the oscillation chamber 11', and half of the power nozzle 17'. Input nipple or barb 61 is adapted to retain a flexible hose (not shown) by retention rib 62 and provide a supply of fluid under pressure to the power nozzle. The outlet end 63 is connected by hinge 34 to the main body portion 60. Outlet end 63 has a pair of protruding segments 64, 65 which fit snugly in the downstream end of chamber 11' and thereby form a tight seal and constraining fluid flow through outlet aperture 10' formed between members 64 and 65. Molded detent members 66 are received in detent cavities 67 to latch the outlet end to the main body member 60 and the abutting faces 69 on outlet members 63 and 70 on the member 60 surrounding or bounding the end of chamber 11' to form a second seal area and prevent leaking.

The top 55 and bottom 56 walls can be at an angle to each other in the manner shown in the aforementioned Bray patents.

THE PRESENT INVENTION

The instant invention is illustrated in FIGS. 9–18. Referring to the schematic diagram shown in FIG. 9, a rectangular oscillation chamber 100 has an upstream end wall 101 with a fluid inlet or power nozzle 102 straddling centerline CL, a downstream end wall 103 with a fluidic outlet opening 104 straddling the centerline CL. The lateral ends of the upstream 101 and downstream 103 end walls are connected by laterally spaced sidewalls SW1 and SW2, respectively. Sidewalls SW1 and SW2 are shown as being generally parallel, but they may optionally diverge from each other in a downstream direction from the upstream end wall 101. The power nozzle 102 includes a short passage 102S which has, in a preferred embodiment, straight walls coupling to a source 106 of fluid under pressure. A jet fluid issuing into the oscillation chamber is caused to oscillate as illustrated in FIGS. 2–7.

A transverse interconnect passage or channel 107 interconnects portions of the chamber to each side of centerline CL proximate or near the downstream end wall 103. In the preferred embodiment, the openings or ends E1 and E2 of interconnect passage 107 are in the top or bottom walls of the chamber. Interconnect passage 107 enhances the sweep angle by making it substantially larger (in some cases, more than doubling the sweep angle) and it also makes the oscillations more periodic.

Referring to FIG. 10, a first plate member 110 has an oscillation chamber 111 molded therein, power nozzle 112 in upstream wall 113, an outlet opening 114 in downstream wall 115, a pair of short diverging walls 116 and 117 provides physical sweep angle limiting boundaries. Pipe 119 is coupled to a bore 120 conveying operative fluid to the power nozzle 112, which issues a jet of fluid under pressure into oscillator chamber 111.

A second plate 118 is joined to plate 110 to provide a top wall to chamber 111. Plate 118 has a pair of spaced holes or bores 121, 122, one on each side of centerline CL and proximate downstream end wall 115. The ends of the spaced bores 121, 122 are connected by a transverse passage 123 to form an interconnect passage. The interconnect passage has the effect of making the sweep angle significantly larger (for example 25–35 degrees is enlarged to 50–70 degrees; 45–55 degrees is enlarged to 90–100 degrees, as another example).

Moreover, oscillators of the type shown in FIGS. 2–8 without the interconnect 121, 122, 123 have some aperiodicity in its oscillation. Addition of the interconnect passage or channel improves the periodicity of the oscillations, and as a result, the droplets formed when the jet is issued to ambient have spray uniformity and size distribution which is substantially the same as oscillators of the type disclosed in Stouffer U.S. Pat. No. 4,508,267. In particular, when used as a nozzle for vehicle windshields, the spray distribution and droplet size range are especially useful with little or no dwell at the ends of the sweep. The power nozzle has straight sides over a predetermined length N×W (where W is the width of the power nozzle).

FIGS. 11*a*, 11*b* and 12 illustrate an embodiment of the invention which has been molded in one-piece. In this embodiment, which is designed to be a cowl mounted and spray the windshield of a vehicle, the nozzle 130 includes a conventional downwardly projecting wash fluid feed barb 131 having a tapered annular rib 132 over which rubber tubing 133 is forced to be frictionally retained at greater than the maximum pressure level of wash fluid from a pump, not shown. The base 134 may include one or more spring finger (not shown) for engaging the cowl and retaining the nozzle in place, or a screw hole may be provided for this purpose. Wash fluid feed barb 131 has a passage 135 for coupling wash fluid to power nozzle 136. Power nozzle 136, in this embodiment has a width W and straight sidewalls 137, 138, which are about two W long. The depth of power nozzle is about one W. Oscillation chamber 139 receives a jet of wash liquid from power nozzle 136, and in this embodiment, the power nozzle is symmetrical to each side of centerline CL, with upstream wall 140 bisected thereby and is about five W wide. Oscillation chamber 139 has parallel top and bottom walls 141 and 142, respectively, and parallel sidewalls 143 and 144 which are about eight W long.

The downstream end wall 145 is connected by a molded hinge 146 to the main molded body and is retained in place by complementary groove-rib 147 in the edges 149 of closure panel 148 and recess 150. Separate retention detent or barbs 66' in holes 67' may be used. Outlet 151 has a pair of short sidewalls 21'' and 22'', which define the physical boundary of the maximum sweep angle.

The present invention resides in the interconnect 160 passage which is bounded or closed-off on one side by closure panel 148. Interconnect passage 160 is generally "U" shaped and molded recessed in the surface 161 so that when closure panel 148 is rotated on hinge 146 to the sealing position shown in FIG. 12, the open side of the "U" shape is closed thereby. As shown in the enlarged view of FIG. 11*b*, and in FIG. 12, the interconnect has a pair of vertical legs 163, 164 joined by a cross leg 165. As shown in FIG. 12, the "U" shaped interconnect passage 160 interconnects portions of the oscillation chamber proximate downstream end wall and on each side of the centerline. The result is a significantly larger sweep angle (for example, by blocking the passage interconnect in a given oscillator device, the sweep angle may be about 45 degrees and with the interconnect passage open, as disclosed herein, the sweep angle expands to 90 degrees, or greater). In addition, the periodicity of the oscillations is improved with the further result that the efficiency is improved.

In FIGS. 11 and 12, the top and bottom walls of the oscillation chamber are parallel. In the embodiment shown in FIGS. 13–17, one of the top 141' or bottom walls 142, preferably the top wall 141', diverges so as to provide an oscillation chamber having a taper therein, and in the embodiment shown in FIGS. 15–17, the exemplary dimensions reflect a taper of about 7.5 degrees. Elements corresponding to hose in FIGS. 11–12 are been primed. The stabilizer ribs shown in our U.S. patent application Ser. No. 07/771,979 may also be incorporated and formed on the tapered or diverging top or bottom wall surface.

Instead of molding the "U" shaped interconnect 160 in wall 161, it can be molded in closure panel member 148', as shown in FIGS. 16–18. In this case, a portion of the ceiling surface adjacent the outlet is molded in the closure member. The horizontal leg 165' and the legs 163', 164' of the interconnect are molded in closure member 148', which is connected by molded hinge 146' to the main oscillator body member. It will be appreciated that in some cases, a portion of the interconnect may be molded in the main body member and a portion molded in the closure member so that on closing the closure member, the full interconnect is formed.

FIG. 19 is a plan view of a silhouette of a fluidic oscillator similar to FIG. 9 incorporating the invention and having diverging sidewalls SW3 and SW4.

While preferred embodiments of the invention have been shown and described herein, it will be appreciated that various adaptations, modifications, and other embodiments will be apparent to those skilled in the art.

What is claimed is:

1. A low pressure fluidic oscillator, comprising:

an oscillation chamber having a centerline, and a pair of mutually facing and complementary-shaped sidewalls and planar top and bottom walls, upstream end and downstream end walls, means forming an input power nozzle in said upstream end wall having a width W and a depth D, for issuing a stream of fluid into said oscillation chamber, and form alternately pulsating vortices in said oscillation chamber on each side of said stream, respectively, an outlet opening formed in said downstream end wall and substantially axially aligned with said power nozzle, a pair of short sidewalls diverging in a downstream direction from said outlet opening, and means forming an interconnect passage proximate said downstream end wall interconnecting downstream portions only of said oscillation chamber on each side of said centerline.

2. The fluidic oscillator defined in claim 1 wherein one of said top and bottom walls are planar and diverge from each other at least from said power nozzle to said outlet opening and said interconnect passage is formed in at least one of said top and bottom walls.

3. The fluidic oscillator defined in claim 1 wherein said complementary-shaped sidewalls are straight.

4. The fluidic oscillator defined in claim 1 wherein said complementary-shaped sidewalls are straight and diverge from each other in the direction of said outlet opening.

5. A one-piece moldable fluidic oscillator comprising the fluidic oscillator defined in any one of claims 1 through claim 4 wherein said oscillator is molded in a single piece, and wherein said second end wall is a closure member hingedly connected to one of said sidewalls, and means forming a friction fit at the end of said chamber for receiving said hingedly connected second end wall and wherein said interconnect passageway is formed as an open "U" shaped recess in one of said top and bottom walls with the open side thereof facing downstream and closed-off by said closure member.

6. A liquid oscillator having means forming an oscillation chamber having a centerline, an upstream wall and a power nozzle means formed in said upstream wall for issuing a jet of liquid into said oscillation chamber, a downstream wall having liquid outlet means therein for issuing a sweeping liquid jet to ambient, said power nozzle means and said liquid outlet means being aligned along said centerline, a pair of spaced sidewalls connecting the lateral ends of said upstream and downstream walls, respectively, top and bottom walls, and interconnect passage means proximate said downstream wall and interconnecting the portions of said oscillation chamber at each side of said centerline for enhancing the sweep angle of the jet issued to ambient and causing the oscillations in said oscillation chamber to be more periodic.

* * * * *